US007854223B1

(12) United States Patent
Latimer, III

(10) Patent No.: US 7,854,223 B1
(45) Date of Patent: Dec. 21, 2010

(54) HEAT EXCHANGER FOR A LOG-BURNING FIREPLACE

(76) Inventor: Julian A. Latimer, III, 101 Eisenhower Dr., Richmond, VA (US) 23227

( * ) Notice: Subject to any disclaimer, the term of this patent is extended or adjusted under 35 U.S.C. 154(b) by 391 days.

(21) Appl. No.: 12/218,399

(22) Filed: Jul. 16, 2008

(51) Int. Cl.
*F24B 1/188* (2006.01)

(52) U.S. Cl. ..... 126/523; 126/500; 126/521; 126/524

(58) Field of Classification Search ..... 126/552, 126/524, 523, 521, 509, 500, 83, 77, 67, 126/60; 165/121, 122, 165, 170, 176
See application file for complete search history.

(56) References Cited

U.S. PATENT DOCUMENTS 2,359,197 A * 9/1944 Brooks ..... 126/507
3,896,785 A * 7/1975 Nelson ..... 126/521
3,995,611 A * 12/1976 Nelson ..... 126/521
4,008,706 A * 2/1977 Buanno ..... 126/521
4,062,345 A * 12/1977 Whiteley ..... 126/513
4,074,681 A * 2/1978 Whiteley ..... 126/521
4,077,388 A * 3/1978 Whiteley ..... 126/522
4,149,517 A * 4/1979 Horwinski ..... 126/521
4,154,214 A * 5/1979 Owens ..... 126/521
4,170,218 A * 10/1979 Hartley ..... 126/521
4,174,701 A * 11/1979 Gneiting ..... 126/516
4,200,086 A * 4/1980 Kolb ..... 126/66
4,240,401 A * 12/1980 Chesnut et al. ..... 126/522
4,257,390 A * 3/1981 Synan ..... 126/522
4,445,497 A * 5/1984 Kilday, Sr. ..... 126/516
4,446,848 A * 5/1984 Becker et al. ..... 126/521
4,646,815 A * 3/1987 Iwata et al. ..... 165/56
5,009,219 A * 4/1991 Liet ..... 126/523
5,038,754 A * 8/1991 Scala ..... 126/521
5,904,137 A * 5/1999 Salley ..... 126/522

* cited by examiner

*Primary Examiner*—Steven B. McAllister
*Assistant Examiner*—Desmond Peyton
(74) *Attorney, Agent, or Firm*—Norman B. Rainer

(57) ABSTRACT

A heat recovery apparatus for an indoor fireplace includes a plenum chamber of low profile box-like construction having a front extremity with a portion that permits forced entry of air and a horizontally spaced portion that permits emergence of heated air. A divider wall centered within the chamber between the entry and emergence portions produces a passageway that controls the flow of air within the chamber.

3 Claims, 2 Drawing Sheets

HEAT EXCHANGER FOR A LOG-BURNING FIREPLACE

BACKGROUND OF THE INVENTION

1. Field of the Invention

The present invention relates to apparatus for improving the room-heating efficiency of a fireplace, and more particularly concerns apparatus having an enclosure adapted to be positioned below burning logs and through which heated air can be blown for useful effect.

2. Description of the Prior Art

Many homes and offices are equipped with fireplaces to provide heat during cold weather. The heat is generated by burning logs or log substitutes within the fire chamber of the fireplace. Radiant heat from the burning material heats the room. Although the radiant heat generated by the burning material supplies heat to the room, the majority of the heat thus generated is discharged through the flue of the fireplace and out through the chimney in the form of heated gases. These gases must be discharged for safety reasons and cannot be vented into the home or office without seriously endangering the occupants thereof. It would accordingly be highly desirable to have a device which could capture at least a portion of the otherwise lost radiant heat and heat from the combustion gases and transfer such captured heat into the home or office. Because many existing fireplaces could benefit from such a device, it would be a further benefit if the device could be easily installed within an existing fireplace.

The use of devices which capture heat from a fireplace in the form of heated air and direct such heated air forwardly into the room having the fireplace is well known. Such devices generally employ a plenum chamber positioned below the burning logs, and an electrically operated blower which advances air through the chamber, causing the air to be heated by heat exchange effect and exit into the room. Examples of such devices are disclosed in U.S. Pat. Nos. 4,074,681; 5,038,754; 5,904,137; 6,145,502; 6,463,926; 7,111,623 and 7,258,116.

In most instances, the plenum chamber is intended to rest upon the floor of the fireplace and is comprised of conduits arranged in a horizontal profile extending the width of the fireplace in a manner enabling the chamber to serve as a grate for supporting the logs. Fabrication of the assemblage of conduit components is expensive, especially where a high degree of tortuosity is employed to increase the total heat transfer surface area. Furthermore, multi-component heat exchange units cause problems with respect to the removal of residual ash and debris from the fireplace, and if such debris is not removed, it seriously impairs the heat exchange efficiency of the unit. Components such as tubing, which may provide high efficiency of heat exchange, generally lack durability in fireplace conditions.

It is thus an object of the invention to provide a fireplace heat exchanger that can capture at least a portion of the heat from the burning material within a fireplace and transfer the captured heat into a room.

It is a further object of the invention to provide a fireplace heat exchanger that can be easily installed within an existing fireplace.

It is another object of the present invention to provide a fireplace heat exchanger which does not interfere with the removal of debris from the fireplace.

It is a still further object of this invention to provide a fireplace heat exchanger of the aforesaid nature which is of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a heat recovery apparatus for an indoor fireplace comprising:

a) a plenum chamber comprised of:
   1) flat upper and lower panels in spaced apart horizontal orientation, each bounded by straight front and rear edges, and opposed side edges extending between said front and rear edges in joinder therewith,
   2) vertically oriented side and rear boundary walls extending between said panels in joinder with said side and rear edges, respectively, thereby defining an open front extremity of said chamber, and a vertical plane of symmetry centered between said side edges, and
   3) a divider wall extending vertically between said upper and lower panels upon said plane of symmetry and serving to define inlet and outlet portions of said plenum chamber, said divider wall having a length reaching from said open front extremity to a distal end located between 70% and 75% of the distance between said front extremity and said rear boundary wall, causing the space between said distal end and rear boundary wall to be an air passageway, b) a forward compartment associated with said inlet portion at said open front extremity and extending between said divider wall, and a side boundary wall, and c) electrically operated air forwarding means interactive with said forward compartment, whereby d) air driven by said air forwarding means is caused to enter said inlet portion, pass through said passageway and outlet portion, and exit said plenum chamber through the open front extremity of said outlet portion.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
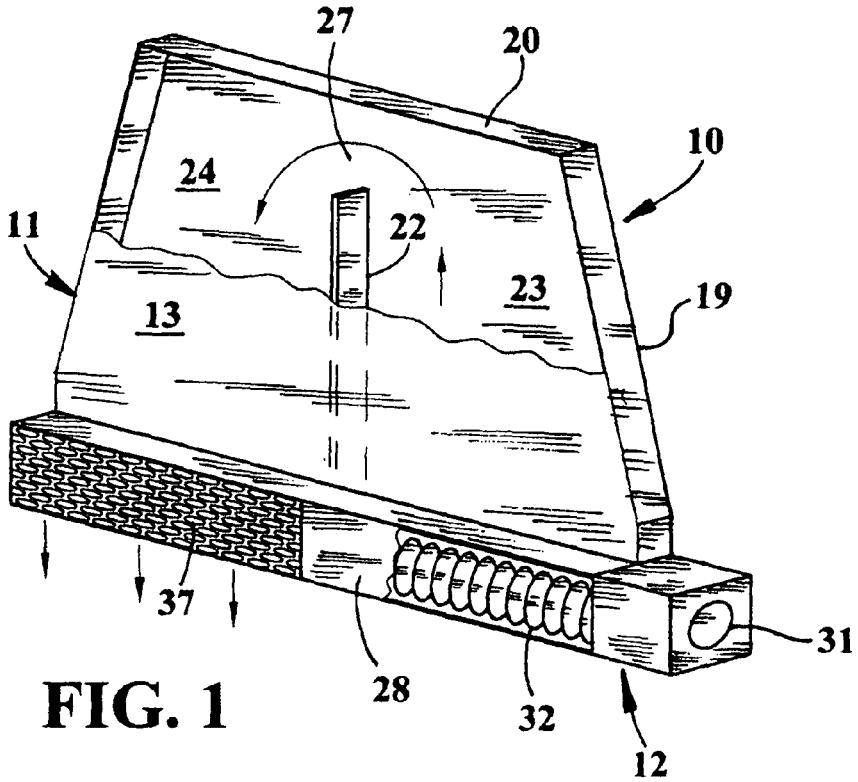
FIG. 1 is a top and front perspective view of an embodiment of the heat recovery apparatus of this invention, with portions broken away to reveal interior details.
Figure 2:
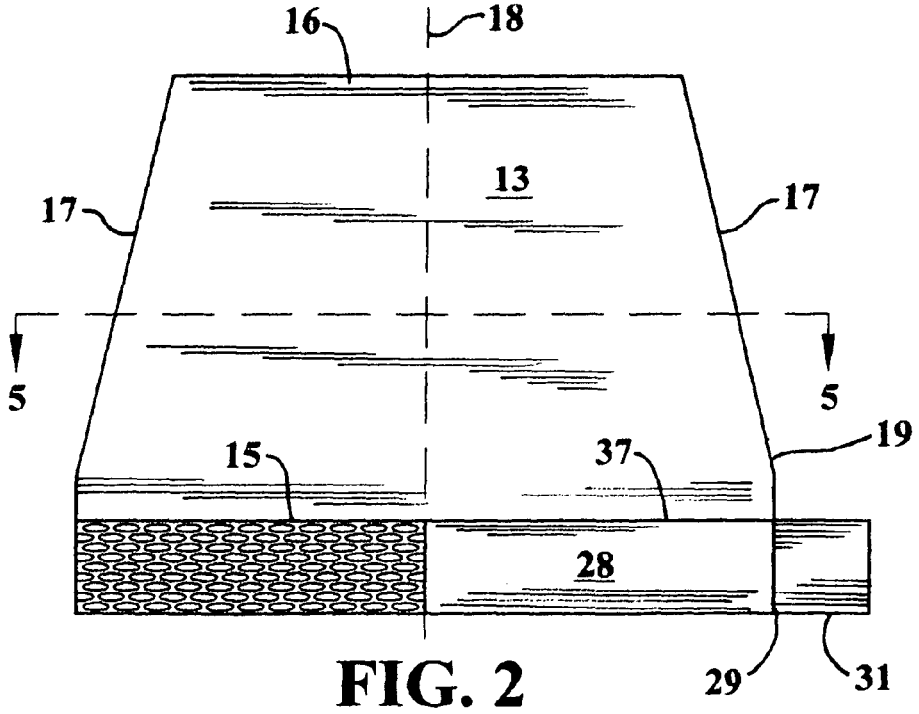
FIG. 2 is a top view of the embodiment of FIG. 1.
Figure 4:
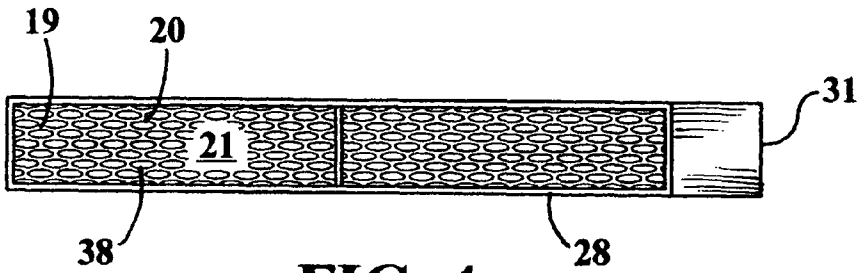
FIG. 4 is a front view of the embodiment of FIG. 1.
Figure 5:
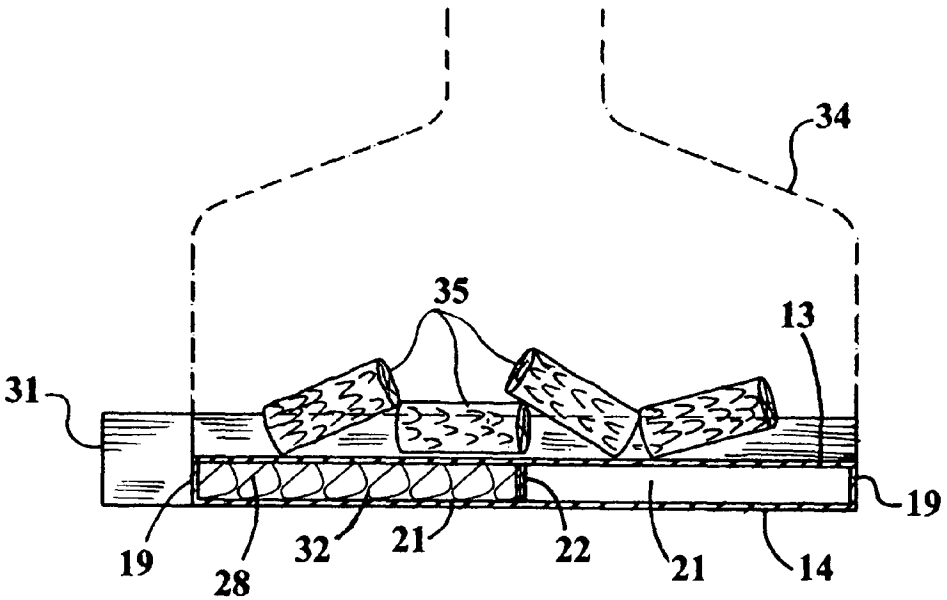
FIG. 5 is a sectional view taken in the direction of the arrows upon line 5-5 of FIG. 2.
Figure 3:
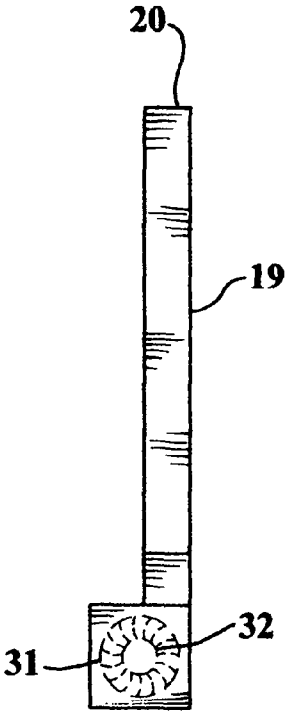
FIG. 3 is a right side view of the embodiment of FIG. 1.

Referring now to FIGS. 1-5, an embodiment 10 of the heat recovery apparatus of the present invention is shown comprised of plenum chamber 11 and electrically operated air forwarding means 12.

Chamber 11, fabricated of welded steel components, is comprised of flat upper and lower panels 13 and 14, respectively, spaced apart by about 1 to 3 inches in parallel relationship. Each panel is bounded by straight front and rear edges, 15 and 16, respectively, and opposed side edges 17 extending between corresponding front and rear edges in joinder therewith, producing a generally trapezoidal shape having a vertical plane of symmetry 18 centered between side edges 17. Other shapes are, however, contemplated.

Vertically oriented side and rear boundary walls 19 and 20, respectively, extend between said panels in joinder with said side and rear edges, respectively, thereby defining an open front extremity 21 of chamber 11. Said boundary walls and lower panel 14 are preferably fabricated of 3/16 inch thick steel plate. Upper panel 13 is preferably of ¼ inch thickness. Rear boundary wall 19 may measure 19-23 inches in length. The side boundary walls preferably have a length similar to the length of the rear boundary wall. Said open front extremity may have a length between about 27 and 33 inches.

A divider wall 22 extends vertically between said upper and lower panels upon said plane of symmetry, and defines inlet and outlet portions 23 and 24, respectively, of chamber 11. Said divider wall, which begins at open front extremity 21, is directed toward rear boundary wall 20, and terminates at distal end 26 located between 70% and 75% of the distance between front extremity 21 and rear boundary wall 20. The space 27 between distal end 26 and rear boundary wall 20 constitutes an air passageway.

A forward compartment 28 is associated with inlet portion 23 at front extremity 21 and extends between plane of symmetry 18 and an outer extremity 29 adjacent a side boundary wall.

Air forwarding means employing an electric motor 31 is attached to the lateral extremity 29 of compartment 28. Elongated impeller means exemplified as squirrel-cage type assembly 32 driven by motor 31, extends within compartment 28. Motor 31 is preferably operable on conventional residential 110-120 volt AC current. The air forwarding capacity is preferably between 200 and 250 cubic feet/minute. Compartment 28 is preferably equipped with an air intake aperture equipped with a protective grill 37, and adjustable closure means to control the amount of air entered into inlet portion 23. A protective grill 38 is also preferably positioned upon front extremity 21.

By virtue of its specialized manner of construction, the heat recovery apparatus of this invention is easily fabricated from sheet metal stock employing simple cutting and welding techniques. When employed as an insert for a conventional fireplace 34, shown in phantom outline in FIG. 5, logs 35 can be burned in a manner to efficiently transfer the heat of combustion to the air stream routed through the plenum chamber and into the room as shown by the arrowed lines in FIG. 1. Furthermore, the debris left behind from the combustion of the logs is deposited upon upper panel 13, from which it is easily removed.

The heat recovery efficiency of the apparatus of this invention can be further increased by shaping upper panel 13 to make tight-fitting abutment with the fireplace walls. By comparing the amount of heat delivered by the apparatus of this invention burning wood with the equivalent amount of heat provided by fuel oil burning furnaces, and factoring in the comparative costs of fireplace wood and fuel oil, the apparatus of this invention reduces home heating cost by 30% to 50%.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A heat recovery apparatus for an indoor fireplace comprising:

a) a plenum chamber comprised of:

1) flat upper and lower panels in spaced apart horizontal orientation, each bounded by straight front and rear edges, and opposed side edges extending between said front and rear edges in joinder therewith, 2) vertically oriented side and rear boundary walls extending between said panels in joinder with said side and rear edges, respectively, thereby defining an open front extremity of said chamber, and a vertical plane of symmetry centered between said side edges, and 3) a divider wall extending vertically between said upper and lower panels upon said plane of symmetry and serving to define inlet and outlet portions of said plenum chamber, said divider wall having a length reaching from said open front extremity to a distal end located between 70% and 75% of the distance between said open front extremity and said rear boundary wall, causing the space between said distal end and rear boundary wall to be an air passageway, b) a forward compartment associated with said inlet portion at said open front extremity and extending between said divider wall and a side boundary wall, and c) electrically operated air forwarding means interactive with said forward compartment, whereby d) air driven by said air forwarding means is caused to enter said inlet portion, pass through said passageway and outlet portion, and exit said plenum chamber through the open front extremity of said outlet portion, wherein said heat recovery apparatus is fabricated by the welding of steel plate components and wherein said upper and lower panels are spaced apart by 1 to 3 inches in parallel relationship, causing said plenum chamber to have a generally trapezoidal shape.

2. The apparatus of claim 1 wherein said air forwarding means includes elongated impeller means extending within said forward compartment.

3. The apparatus of claim 2 wherein a protective grill is associated with said open front extremity and forward compartment.

* * * * *